United States Patent [19]

Hansen

[11] 4,432,709

[45] Feb. 21, 1984

[54] INTERNALLY SHAFTED PLANETARY PISTON ENGINE

[75] Inventor: Christian B. Hansen, Nordborg, Denmark

[73] Assignee: Danfoss A/S, Nordborg, Denmark

[21] Appl. No.: 288,028

[22] Filed: Jul. 29, 1981

[30] Foreign Application Priority Data

Aug. 9, 1980 [DE] Fed. Rep. of Germany ..... 3030203

[51] Int. Cl.[3] ..... F03C 2/00

[52] U.S. Cl. ..... 418/61 B; 418/102

[58] Field of Search ..... 418/61 B, 102; 137/625.24

[56] References Cited

U.S. PATENT DOCUMENTS

| | | | |
|---|---|---|---|
| 2,877,668 | 3/1959 | Kelbel | 137/625.24 X |
| 3,385,057 | 5/1968 | Pruvot et al. | 418/61 B X |
| 3,871,798 | 3/1975 | Berlich | 418/61 B X |
| 4,323,335 | 4/1982 | Hansen | 418/61 B |

*Primary Examiner*—Leonard E. Smith

*Attorney, Agent, or Firm*—Wayne B. Easton

[57] ABSTRACT

The invention relates to a hydraulic pump or motor having inlet and outlet ports and expansible chamber section at one end thereof, which may be a gerator gear set, and a drive shaft at the other end thereof. A distributor valve driven by the drive shaft and having a central bore directs fluid between the inlet and outlet ports in the housing and the expansible chamber section. A shaft, such as a cardan shaft, disposed in the central bore of the valve provides a driving connection between the valve and the expansible chamber forming section. Although a bearing is provided in the housing for the drive shaft, the distributor valve is also subjected to radial loads because the cylindrical surface thereof has a close fitting sealing relationship with the housing bore in which it is rotatably disposed. Lubrication for both ends of the cylindrical surface of the valve is provided by passages extending from valve passages which carry the motive fluid controlled by the valve.

3 Claims, 1 Drawing Figure

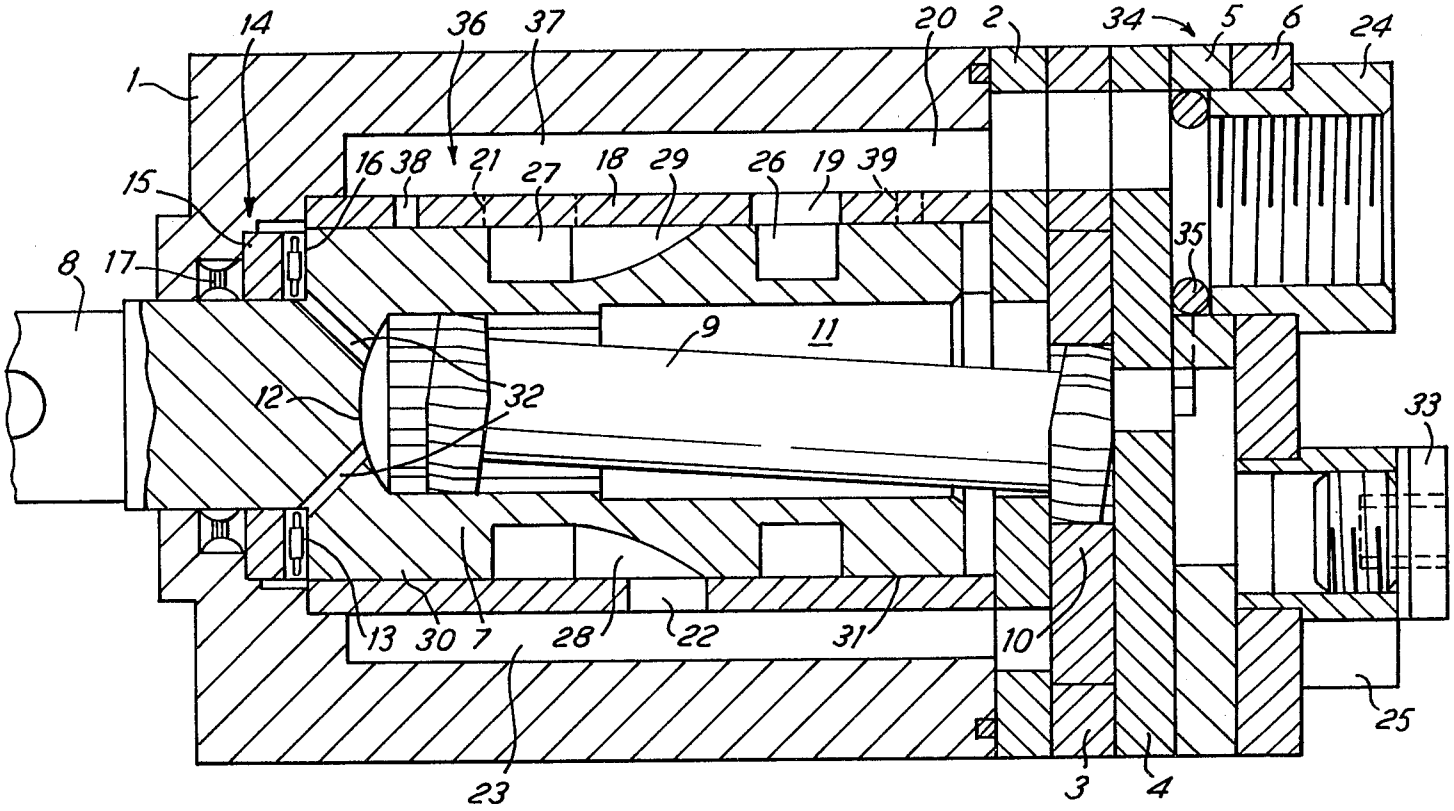
24
6
5
34
2
20
37
36
14
1
15
17
8
16
38
21
27
18
29
26
19
39
9
11
12
32
13
30
7
28
22
31
10
3
4
35
33
25
23

INTERNALLY SHAFTED PLANETARY PISTON ENGINE

The invention relates to an internally shafted planetary piston engine with mesh engagement between a stationary ring gear and a circular rotary gear fixed to turn with a main shaft, the gears defining compression chambers between each other, comprising a rotary valve which is rigidly connected to the main shaft, mounted in a housing bore and has two sets of longitudinal grooves which extend alternately from two axially offset annular grooves each connected to one of the two connections and which sweep over control orifices disposed between the annular grooves and each connected to one compression chamber.

In known machines of this kind (DE-OS No. 26 06 172), mounting of the main shaft is particularly simple because of the grid connection between the main shaft and the rotary valve. The bearing sections located at both ends of the rotary valve have an axial spacing such that there is good support if transverse forces are exerted on the main shaft. In this way it was possible to achieve a life of several thousand hours. Surprisingly, however, some engines already failed after 15 or a few hundred hours.

According to an older suggestion (German Patent Application No. P 29 10 831), a hydraulic planetary piston engine of this kind has been proposed, wherein the hydraulic connections are not at the housing periphery but at the end face and connected to the appropriate annular grooves by way of axial passages. A cup-shaped housing is provided which has a number of axial grooves each connected to one annular groove or to the control orifices. For ease of manufacture, the axial grooves have equal lengths and extend over practically the entire length of the rotary valve. They are covered internally by an apertured sleeve of which the internal surface forms the bore of the housing.

The invention is based on the problem of providing a planetary piston engine of the aforementioned kind wherein a long life is always ensured.

This problem is solved according to the invention by a connecting passage between the annular groove remote from the main shaft and the bearing section of the rotary valve adjacent the main shaft.

The invention is based on the discovery that the difference in life depends on the direction of rotation. The bearing section of the rotary valve adjacent the main shaft is most strongly loaded during operation and is adequately lubricated only if the adjacent annular groove is under pressure. However, this bearing section is inadequately supplied if the adjacent annular groove is under low pressure, i.e. at the outflow pressure in the case of a motor or the suction pressure in the case of a pump. If, now, the said bearing section is also connected to the remotest annular groove with the aid of the connecting passage, it obtains pressure lubrication independently of the direction of rotation and this will ensure the desired long life.

Preferably, the connecting passage is formed by an axial passage section and a radial passage section extending therefrom. This simplifies manufacture because radial and axial passages must in any case be produced.

In particular, the axial passage section may be the extension of an axial passage connecting the annular groove remote from the main shaft to the associated hydraulic connection. Only one additional radial bore need be provided.

If in exceptional cases the bearing section of the rotary valve remote from the main shaft exhibits wear that is dependent on the direction of rotation, a second connecting passage may be provided between the annular groove adjacent the main shaft and the bearing section of the rotary valve remote from the main shaft.

The invention will now be described in more detail with reference to a preferred example illustrated in the drawing. The single FIGURE is a longitudinal section through a planetary piston engine according to the invention.

The housing of the illustrated planetary piston engine comprises a cup-shaped main portion 1, an intermediate plate 2, a stator in the form of a ring gear 3, a further intermediate plate 4, a valve plate 5 and an end plate 6, which are rigidly interconnected by means of bolts (not shown). A rotary valve 7 is made in one piece with a main shaft 8 and is connected by a cardan shaft 9 to a rotor in the form of a gear 10. The sleeve of the rotary valve exhibits an intenal chamber 11 which is closed at one end by a wall 12. It also has an end wall 13 which lies against an axial bearing 14 consisting of a bearing plate 15 and a roller bearing 16. The bearing plate 15 bounds a groove in which there is a main shaft seal 17.

The main portion 1 is provided internally with a sleeve 18. This has an orifice 19 connected to an axial passage 20, a further orifice 21 communicating with a further axial passage disposed beyond the plane of the drawing, and control orifices 22 therebetween in communication with control passages 23. The control passages lead to the compression chambers formed between the teeth of the ring gear 3 and gear 10, the axial passage 20 leads to a hydraulic connection 24, and the axial passage which is not shown leads to a hydraulic connection 25.

The rotary valve 7 has an annular groove 26 connected to the orifice 19 and an annular groove 27 connected to the orifice 21. Longitudinal grooves 28 and 29 reaching up to the zone of the control orifices 22 extend alternately from these annular grooves. Axially beyond the annular grooves there are two bearing sections 30 and 31 by which not only the rotary valve 7 but also the main shaft 8 are mounted in the housing.

The interior chamber 11 of the rotary valve 7 communicates with the axial bearing 14 by way of passages 32 and can be emptied after undoing an outlet screw 33. A check valve arrangement 34 comprises an elastic annular valve element 35 facing each connection 24 and 25. This element seals the connection of higher pressure from the interior chamber 11 but connects the interior chamber to the connection of lower pressure if the pressure in the interior chamber should rise.

The planetary piston engine described thus far is explained in more detail in prior Application No. P 29 10 831.4.

To produce a connecting passage 36 between the annular groove 26 remote from the main shaft 8 and the bearing section 30 adjacent the main shaft 8, use is made of an axial passage section 37 which is an extension of the axial passage 20 and a radial passage section 38 in the form of a bore. This ensures that the bearing section 30 always receives pressure lubrication. If the annular groove 27 is at the higher pressure, pressure fluid penetrates along the bearing section 30 into the vicinity of the axial bearing 14 and further into the interior chamber 11 where the pressure is lower. On the other hand, if the annular groove 26 is at a higher pressure, pressure fluid arrives through the connecting passage 36; one part passes through the vicinity of the axial bearing 14 to the interior chamber 11 and another part to the annular groove 27. In this way one obtains certain lubrication of the bearing section 30 independently of the direction of rotation, thereby achieving a long life for any kind of operation.

Similarly, the bearing section 31 may also be connected by way of a radial connecting passage 39 to the axial passage (not shown) which leads from the connection 25 to the annular groove 27. In this way, the bearing section 31 will also be supplied with pressure fluid independently of the direction of rotation, namely either directly from the annular groove 26 or by way of the connecting passage 39.

Such connecting passages can also be used if the hydraulic connections are located at the periphery of the housing. The suggestion is particularly suitable for hydraulic motors and especially micro-motors in which the transverse loading of the main shaft is comparatively large related to the bearing surface.

I claim:

1. A hydraulic pump or motor, comprising a cylindrically shaped housing having optionally and selectable inlet and outlet ports and drive shaft bearing means at one end thereof, said housing defining a valve bore, a cylindrically shaped valve having a central bore and being rotatably disposed in said valve bore, drive shaft means journalled in said bearing means and being connected to said valve means in driving relation thereto, expansible chamber forming means in said housing at the end thereof opposite said bearing means, drive means in said central bore connecting said valve in driving relation to said expansible chamber forming means, valving means in said valve disposed centrally thereof relative to the ends thereof, said valving means including first and second axially spaced annular grooves, first valving passages in said housing connecting said expansible chamber forming means to said valving means, second valving passages in said housing connecting said inlet and outlet ports to said annular grooves of said valving means, lubrication passage means in said housing adjacent both ends of said central bore providing fluid communication between said second valving passages and said central bore near said ends thereof to provide lubrication for the outer surface of the ends of said valve adjacent said ends.

2. A hydraulic pump or motor according to claim 1 wherein said second valving passages have portions thereof extending axially in said housing to the vicinity of said drive shaft bearing means, said lubrication passage means being between at least one of said portions of said central bore near the end thereof adjacent said bearing means to provide lubrication for said bearing means.

3. A hydraulic pump or motor according to claim 2 wherein said valving means include control orifices having fluid communication with said valve bore between said annular grooves.

* * * * *